US005174730A

United States Patent [19]

Nieuwkamp et al.

[11] Patent Number: 5,174,730

[45] Date of Patent: Dec. 29, 1992

[54] HIGH-PRESSURE CLEANING APPARATUS

[75] Inventors: Wolfgang Nieuwkamp, Backnang; Horst Bauer, Winnenden, both of Fed. Rep. of Germany

[73] Assignee: Alfred Karcher GmbH, Winnenden, Fed. Rep. of Germany

[21] Appl. No.: 613,525

[22] PCT Filed: May 23, 1989

[86] PCT No.: PCT/EP89/00564

§ 371 Date: Nov. 8, 1990

§ 102(e) Date: Nov. 8, 1990

[87] PCT Pub. No.: WO89/11345

PCT Pub. Date: Nov. 30, 1989

[30] Foreign Application Priority Data

May 25, 1988 [DE] Fed. Rep. of Germany ..... 3817641

[51] Int. Cl.[5] ..... F04B 39/02; F04B 39/06

[52] U.S. Cl. ..... 417/366; 417/370

[58] Field of Search ..... 417/366, 370; 239/124, 239/127, 128; 137/389, 391, 423, 240

[56] References Cited

U.S. PATENT DOCUMENTS 2,037,245 4/1936 Leifheit et al. ..... 137/391
2,914,253 11/1959 Jobus et al. ..... 239/124
3,744,935 7/1973 Magni ..... 417/366

FOREIGN PATENT DOCUMENTS 2473912 7/1981 France .
2504206 10/1982 France .

*Primary Examiner*—Richard A. Bertsch
*Assistant Examiner*—Alfred Basichas
*Attorney, Agent, or Firm*—Barry R. Lipsitz

[57] ABSTRACT

In a high-pressure cleaning apparatus with a high-pressure pump for a cleaning liquid connected on the suction side to a preliminary tank with a feed pipe for cleaning liquid and having in the pressure pipe a bypass pipe branching off from this pressure pipe and leading to the preliminary tank, and with an electromotor driving the high-pressure pump and having a coolant pipe through which cleaning liquid flows, in order to also ensure effective cooling of the electromotor in the recirculation mode without loss of coolant, it is proposed that the feed pipe to the preliminary tank have a greater conveying capacity than the coolant pipe and that the coolant pipe lead into the preliminary tank in which there is a means for limiting the filling level.

8 Claims, 1 Drawing Sheet

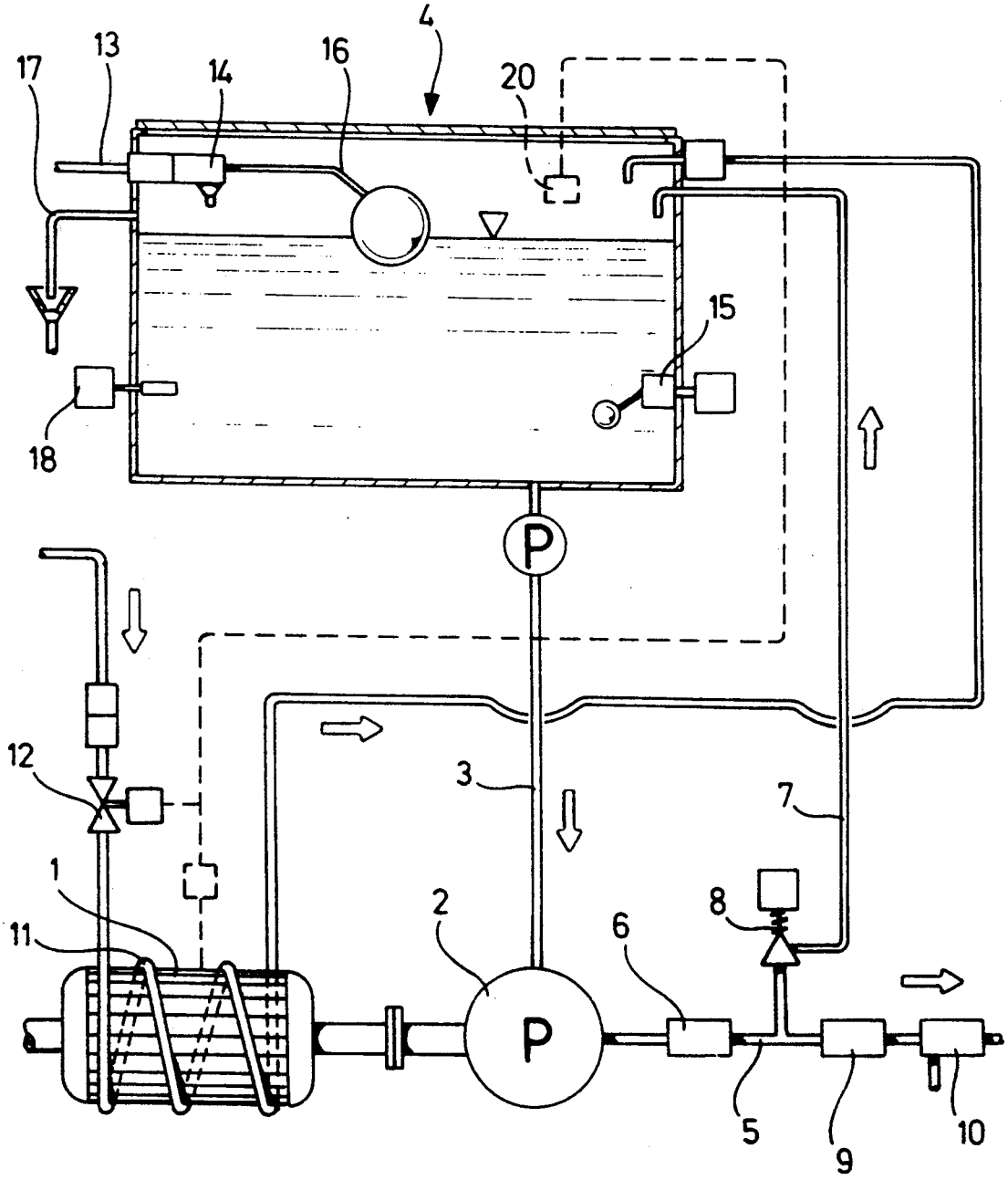
4
13
17
14
16
20
15
18
P
12
3
7
1
2
8
6
11
P
5
9
10

HIGH-PRESSURE CLEANING APPARATUS

The invention relates to a high-pressure cleaning apparatus with a high-pressure pump for a cleaning liquid connected on the suction side to a preliminary tank with a feed pipe for cleaning liquid and having in the pressure pipe a bypass pipe branching off from the pressure pipe and leading to the preliminary tank, and with an electromotor driving the high-pressure pump and having a coolant pipe through which cleaning liquid flows.

In high-pressure pumps, it is advantageous for the electromotor to be cooled by the flow of cleaning liquid. However, difficulties may arise when the discharge of cleaning liquid is interrupted for with such apparatus it is customary to allow the pump to continue to operate and to recirculate the liquid conveyed by the pump. Since this liquid is used as coolant, it undergoes constant heating-up in this bypass mode, which is undesired. This applies particularly when heated liquid is to be discharged by the high-pressure cleaning apparatus, i.e., when cleaning liquid which has already undergone heating is fed to the preliminary tank. If the cleaning liquid were discharged into the environment immediately, this heated liquid would still be sufficient to cool the electromotor, but not in the bypass mode where the cleaning liquid flows through the motor repeatedly.

The object of the invention is to so improve a generic high-pressure cleaning apparatus that in the bypass mode, too, adequate cooling of the motor is achievable in any case, while excessive heating of the coolant is avoided.

This object is accomplished in accordance with the invention with a high-pressure cleaning apparatus of the kind described at the beginning by the feed pipe to the preliminary tank having a greater conveying capacity than the coolant pipe, by the coolant pipe leading into the preliminary tank and by a means for limiting the filling level being provided in the preliminary tank.

This means for limiting the filling level may be an overflow pipe. However, provision may also be made for the means for limiting the filling level to include a filling level indicator in the preliminary tank, a closure valve in the coolant pipe actuated by the filling level indicator and a switch for switching off the electromotor.

In the normal mode in which cleaning liquid is discharged, the smaller portion of the cleaning liquid travelling through the coolant pipe into the preliminary tank is thus conveyed away together with the main portion of the cleaning liquid fed directly into the preliminary tank. In the bypass mode, fresh cleaning liquid, i.e., not preheated coolant, is always fed to the coolant pipe. This is then delivered to the preliminary tank and gradually fills the latter up until it is full. The means for limiting the filling level prevents excessive filling of the preliminary tank. Since the component of the entire cleaning liquid that flows through the coolant pipe is small in proportion to the main component, effective cooling of the motor can thus be maintained for a long period of time in the bypass mode with no loss of coolant occurring as it can be collected in the preliminary tank.

It is advantageous for a closure member and a top and a bottom filling level indicator for actuating the closure member to be provided in the preliminary tank. In this way, the preliminary tank is filled essentially through the feed pipe and fully automatically by the two filling level indicators ensuring that the level of filling is always between the top and bottom filling levels.

It is advantageous for the top filling level indicator to be arranged beneath the level of the means for limiting the filling level. In this way, even when the preliminary tank is filled completely by the feed pipe, there is always a certain volume of the preliminary tank left over which can be filled up by the cleaning liquid flowing through the coolant pipe. Since the component of the cleaning liquid which flows through the coolant pipe is relatively small, cooling of the electromotor is thus possible over quite a long period of time in the bypass mode without loss of the cleaning liquid used for this. On the other hand, the feed pipe with the closure members actuated by the two filling level indicators ensures in the normal discharge mode that the preliminary tank is not completely emptied and can always supply cleaning liquid.

It is particularly expedient for the direct feed pipe to the preliminary tank to be connected to a supply of heated cleaning liquid, the coolant pipe to the electromotor, on the other hand, to a supply of cold cleaning liquid. In this way, in the discharge mode the discharge of preheated cleaning liquid is possible without preheated cleaning liquid having to be fed to the electromotor for cooling purposes. The electromotor can be cooled further with cold cleaning liquid, yet when this cold cleaning liquid heated in the electromotor is introduced into the preliminary tank, the temperature of the cleaning liquid collected in the preliminary tank drops to only a minor degree as the amount of the coolant is small in proportion to the amount of cleaning liquid fed through the feed pipe and the cleaning liquid is heated up by the cooling of the electromotor itself.

The following description of a preferred embodiment serves in conjunction with the drawing to explain the invention in further detail.

The drawing shows schematically the design of a high-pressure cleaning apparatus with a preliminary tank and a separate coolant pipe for the electromotor.

An electromotor 1 drives a high-pressure pump 2, for example, a conventional swash-plate reciprocating pump. The latter draws cleaning liquid from a preliminary tank 4 through a suction pipe 3 and discharges this cleaning liquid through a pressure pipe 5. Downstream from a check valve 6, there branches off from the pressure pipe 5 a bypass pipe 7 containing a closure valve 8. The bypass pipe 7 leads into the preliminary tank 4.

Downstream from the branch-off of the bypass pipe 7, the cleaning liquid conveyed by the high-pressure pump 2 is conducted to a spraying head, not illustrated in the drawing, for example, a spraying lance or the like. The pressure pipe may contain a check valve 9 and a pressure gauge 10 or a flowmeter.

Associated with the electromotor 1 is a coolant pipe 11 which may, for example, extend in helical configuration in the stator housing. This coolant pipe contains a closure valve 12. Like the bypass pipe 7, it leads into the preliminary tank 4.

A feed pipe 13 containing a closure valve 14 leads into the preliminary tank 4. This closure valve 14 is opened by a bottom filling level indicator 15 and closed by a top filling level indicator 16. These filling level indicators may, for example, be in the form of float switches or electronic filling level indicators. Together they ensure that the filling level in the preliminary tank is always kept between a top filling level and a bottom filling level by the feed pipe 13.

An overflow pipe 17 branches off from the preliminary tank 4 above the top filling level.

The feed pipe 13 to the preliminary tank 4 and the coolant pipe 11 are of such dimensions that the delivery capacity of the feed pipe 13 is considerably greater than that of the coolant pipe 11, i.e., when the feed pipe is open, a considerably larger amount of liquid flows through the feed pipe than through the coolant pipe per time unit. For example, the amount of liquid flowing through the coolant pipe may be 10% of the amount of liquid flowing through the feed pipe 13.

In operation, the preliminary tank 4 is filled by the feed pipe 13 up to the filling level defined by the top filling level indicator 16. The feed pipe is preferably connected to a supply of heated-up cleaning liquid, not illustrated in the drawing, so the preliminary tank is filled up with heated-up cleaning liquid at, for example, a temperature of 80 degrees C. This temperature can be determined with a sensor 18.

The coolant pipe 11, on the other hand, is connected to a supply of cold cleaning liquid, and so the cold cleaning liquid brings about a very effective cooling of the electromotor. The coolant is heated up as it travels through the electromotor and then enters the preliminary tank. Even if the temperature of the coolant does not reach the temperature of the cleaning liquid introduced through the feed pipe 13, the temperature in the preliminary tank is not lowered by this to a very great extent as the amount of the flow of liquid entering through the coolant pipe is low in comparison with that of the feed pipe.

In the normal discharge mode, the cleaning liquid is always introduced simultaneously from the feed pipe 13 and from the coolant pipe 11, with the feed pipe 13 being intermittently interrupted, when necessary, in accordance with the respective filling level.

If the pressure pipe 5 is closed, the closure valve 8 in the bypass pipe 7 opens so the cleaning liquid conveyed by the high-pressure pump 2 is then conveyed back to the preliminary tank 4 again. In this operating mode, cleaning liquid continues to pass through the electromotor and cool it effectively. The cleaning liquid finally reaches the preliminary tank and fills it up until the filling level is limited by the overflow pipe 17. If desired, the electromotor can continue to operate, in which case coolant can no longer fill up the preliminary tank but instead flows through the latter and off through the overflow pipe. Provision may also be made for the high-pressure pump to be switched off after a certain time during which the high-pressure pump has recirculated cleaning liquid. The closure valve 12 in the coolant pipe 11 can then also close the latter so the flow of cleaning liquid through the coolant pipe 11 is interrupted.

With the system described herein, it is possible to deliver heated cleaning liquid and yet achieve very effective cooling of the electromotor with cleaning liquid, even when the apparatus is operating in the recirculating mode and not discharging any cleaning liquid. In spite of this, the supply of cleaning liquid in the preliminary tank is cooled down to only an insignificant extent or not at all although cleaning liquid which is not preheated is used to cool the electromotor. A further advantage is also to be seen in the fact that in the event of failures in the supplying of the cleaning liquid to the preliminary tank, effective cooling of the electromotor is maintained as the coolant comes from a separate reservoir.

While in a preferred embodiment, the filling level in the preliminary tank is limited by the overflow pipe 17, it is also possible to provide in the preliminary tank instead of this overflow pipe 17 a further filling level indicator 20 which is arranged above the top filling level indicator 16 and, when a corresponding filling level is reached in the preliminary tank, switches off the electromotor 1 and simultaneously interrupts the supply of further cleaning liquid through the coolant pipe 11 by closing the closure valve 12. With such a solution, the duration of the recirculating mode without discharge of cleaning liquid would be limited by the time which passes in order to fill up the preliminary tank 4 from the present filling level to the maximum filling level which is determined by the additional top filling level indicator.

Further pumps driven in the same way by a motor cooled by cleaning liquid can be connected to the preliminary tank 4, with coolant being conveyed back into the preliminary tank again like the liquid flowing through the bypass pipe.

We claim:

1. A high-pressure cleaning apparatus comprising:

a high-pressure pump for a cleaning liquid coupled on a suction side thereof to a preliminary tank;

a feed pipe for feeding cleaning liquid to said preliminary tank;

a pressure pipe coupled to an output of said pump;

a bypass pipe branching off from said pressure pipe and leading to said preliminary tank;

an electromotor for driving said pump and having a coolant pipe through which cleaning liquid flows; and means for limiting the filling level of said preliminary tank, including a filling level indicator in said preliminary tank, a closure valve in said coolant pipe actuated by said filling level indicator and a switch for switching off said electromotor;

wherein said feed pipe has a greater conveying capacity than said coolant pipe and said coolant pipe leads into said preliminary tank.

2. A high-pressure cleaning apparatus in accordance with claim 1 further comprising:

a closure member arranged in said feed pipe; and top and bottom filling level indicators in said preliminary tank for actuating said closure member.

3. A high-pressure cleaning apparatus in accordance with claim 2 wherein said top filling level indicator is arranged underneath said means for limiting the filling level.

4. A high-pressure cleaning apparatus comprising:

a high-pressure pump for a cleaning liquid coupled on a suction side thereof to a preliminary tank;

a feed pipe for feeding heated cleaning liquid to said preliminary tank;

a pressure pipe coupled to an output of said pump;

a bypass pipe branching off from said pressure pipe and leading to said preliminary tank; and an electromotor for driving said pump and having a coolant pipe through which cold cleaning liquid flows;

wherein said feed pipe has a greater conveying capacity than said coolant pipe and said coolant pipe leads into said preliminary tank.

5. A high-pressure cleaning apparatus in accordance with claim 4 further comprising:

a closure member arranged in said feed pipe; and top and bottom filling level indicators in said preliminary tank for actuating said closure member.

6. A high-pressure cleaning apparatus in accordance with claim 5 further comprising:

means for limiting the filling level of said preliminary tank, including a filling level indicator in said preliminary tank, a closure valve in said coolant pipe actuated by said filling level indicator and a switch for switching off said electromotor.

7. A high-pressure cleaning apparatus in accordance with claim 6 wherein said top filling level indicator is arranged underneath said means for limiting the filling level.

8. A high-pressure cleaning apparatus in accordance with claim 4 further comprising:

means for limiting the filling level of said preliminary tank, including a filling level indicator in said preliminary tank, a closure valve in said coolant pipe actuated by said filling level indicator and a switch for switching off said electromotor.

* * * * *